US005925202A

United States Patent [19]

Ide et al.

[11] Patent Number: 5,925,202

[45] Date of Patent: Jul. 20, 1999

[54] COVERED WIRE CONNECTION METHOD AND STRUCTURE

[75] Inventors: Tetsuro Ide; Nobuyuki Asakura, both of Shizuoka-ken, Japan

[73] Assignee: Yazaki Corporation, Tokyo, Japan

[21] Appl. No.: 08/867,420

[22] Filed: Jun. 2, 1997

[30] Foreign Application Priority Data

Jun. 4, 1996 [JP] Japan ..... 8-141884
Oct. 1, 1996 [JP] Japan ..... 8-260928

[51] Int. Cl.[6] ..... B32B 31/16

[52] U.S. Cl. ..... 156/73.2; 156/73.1; 174/84 R

[58] Field of Search ..... 174/72 C, 72 TR, 174/84 R, 94 R, 117 F; 156/49, 52, 53, 73.1, 73.2, 213

[56] References Cited

U.S. PATENT DOCUMENTS

| | | | |
|---|---|---|---|
| 2,250,156 | 7/1941 | Ferguson | 219/10 |
| 3,418,444 | 12/1968 | Ruehlemann | 219/113 |
| 3,573,713 | 4/1971 | Enright et al. | 339/98 |
| 3,910,448 | 10/1975 | Evans et al. | 220/3.8 |
| 4,878,969 | 11/1989 | Janisch | 156/49 |
| 5,584,122 | 12/1996 | Kato et al. | 29/872 |

FOREIGN PATENT DOCUMENTS

| | | | |
|---|---|---|---|
| 4-92377 | 3/1992 | Japan . | |
| 07320482 | 8/1995 | Japan | G11C 11/407 |
| 07322467 | 8/1995 | Japan | H02G 15/08 |
| 2198893 | 6/1988 | United Kingdom . | |

*Primary Examiner*—James Sells
*Attorney, Agent, or Firm*—Finnegan, Henderson, Farabow, Garrett & Dunner, L.L.P.

[57] ABSTRACT

Two covered wires are conductively connected to each other by overlapping with each other at connection portions. The overlapped connection portions are pinched by a pair of resin chips. By melting cover portions and pressing resin chips from outside, the conductive wire portions of the covered wires are conductively contacted with each other at the connection portions. The pair of the resin chips are melt-fixed to each other to seal the connection portions. A crossing angle θ of the two covered wires at the connection portion is set to no less than 45° and greater than 135°. Thus, the covered wires can be conductively connected with each other inexpensively and easily. Further, a connecting state having an excellent electrical characteristic can be obtained stably.

16 Claims, 8 Drawing Sheets

COVERED WIRE CONNECTION METHOD AND STRUCTURE

BACKGROUND OF THE INVENTION

This invention relates to a connection method and structure for connecting covered wires with each other or connecting a covered wire to another member.

As a conventional connection structure for this kind of covered wires, an art proposed by this inventor (see Japanese Laid-Open Patent Application No. 7-320842) will be described.

For connecting two covered wires the outer periphery of which is coated with a cover portion made of resin, at their intermediate connection portions, a pair of resin chips which are of resin material, a horn for producing ultrasonic vibration, and an anvil for supporting the covered wires and resin chips at the time of connection are utilized. The anvil includes a base stand and a support portion projecting from the base stand. The support portion is designed in a substantially cylindrical shape. The support portion has a bore portion which is opened at the opposite side to the base stand side. Two pairs of grooves are formed on the peripheral wall of the support portion so as to cross with each other substantially at the center of the bore portion. The four grooves are formed so as to open on the same side as the bore portion, extending along the projection direction of the support portion and intercommunicate with one another through the bore portion.

The pair of resin chips are designed in a disc shape having a slightly smaller outer diameter than the diameter of the bore portion of the anvil. Furthermore, an end face of a head portion of the horn is designed in a disc shape having an outer diameter which is substantially equal to or slightly smaller than that of the resin chips.

The respective resin chips have solder as soldering material. The solder is embedded substantially in the center of the bottom/top surface such that a circular top face thereof is flush with the bottom/top surface (melting surface) of the upper and lower resin chips.

In order to connect the two covered wires to each other, both of the covered wires are overlapped with each other at the connection portion thereof and the overlapped connection portions are pinched through a solder by the pair of resin chips from the upper and lower sides of the connection portions. Specifically, one of the resin chips (the resin chip at the lower side) is inserted into the bore portion of the anvil such that the melting surface thereof is directed upward. Then, one covered wire is inserted into the pair of confronting grooves from the upper side of the inserted resin chip. Then, the other covered wire is inserted into the other pair of the confronting grooves. Finally, the other (upper side) resin chip is inserted such that the melting surface is directed downward. The covered wires are arranged in the bore portion so that the respective connection portions thereof cross each other at the center of the bore portion. Through this arrangement, the connection portions of the covered wires are pinched substantially at the center of the melting surfaces of the upper and lower resin chips, respectively, in the (vertical) direction.

Subsequently, the cover portions at the connection portions of the covered wires are melted so as to be dispersed by ultrasonic vibration. Furthermore, the conductive wire portions (core) of the covered wires are conductively contacted with each other at the connection portion by pressing the covered wires from the outside of the resin chips. Thereafter, the pair of the resin chips are mutually melt-fixed at the melting surfaces to seal the connection portion.

Specifically, the head portion of the horn is inserted into the bore portion from the upper side bore portion from the upper side of the finally-inserted upper (other) resin chip and placed on the upper resin chip to excite and press the connection portions of the covered wires from the outside of the upper and lower resin chips between the horn and the anvil. The cover portions are first melted and the conductive wire portions of the covered wires are exposed at the connection portion between the resin chips. At this time, the melted cover portions are extruded from the center side of the resin chips toward the outside thereof because the connection portions are pressed from the upper and lower sides, so that the conductive wire portions are more effectively exposed and surely conductively contacted with each other. Like the press direction, the direction of the excitation of the connection portions is set to be coincident with the overlapping direction of the covered wires, so that the action of extruding the melted cover portions from the center side of the resin chips to the outside thereof is promoted.

When the pressing and exciting operation on the connection portions is continued after the melting of the cover portions, the resin chips are melted and the facing melting surfaces of the resin chips are melt-fixed to each other. In addition, the outer peripheral surface portions of the cover portions which are adjacent to the conductively contacted conductive wire portions and the resin chips are melt-fixed. With this operation, the outer peripheral portions of the conductively-contacted conductive wire portions are kept to be coated with the resin chips.

The solder provided in the resin chips is melted by eat generated when the resin chips are melted. Consequently the conductive wire portions of the conductively contacted covered wires are soldered at the connection portions in the resin chips. As a result, a higher electric performance can be obtained at the connection portions thereby further stabilizing the conductive characteristic.

However, in this connection structure, solder must be melted accurately at the same timing in a series connecting process as when the cover portion is melted, such that the conductive wire portion is exposed and contacted with each other. Thus, the solder needs to be buried inside of the resin chips without being exposed through melting surfaces of resin chips, respectively. When burying the solder inside of the resin chips, during the production process of the resin chips, a special treatment for sealing opening portions, for the burying with resin material, is needed after the solder is buried in the resin chips. Thus, increase in cost of the resin chips cannot be avoided.

Further, to melt solder accurately at the required timing, detailed setting and management of a position of the solder in the resin chips and ultrasonic melting condition (particularly temperature) must be conducted. Thus, conductive connecting procedure becomes complicated and is such an intrinsic effect on this technology that conductive connection performed by a simple method may be lost.

Further, the solder needs to contain a mixture of chemical active substance (flux) for improving a leaking characteristic for core wires comprising the conductive wire portion. In this technology which solders the connection portions and simultaneously seals it, this kind of flux needs to be contained in the resin chips. Thus, there is a fear that the connection portions may corrode due to flux, so that conversely, reliability relating to electrical connecting performance may be reduced.

SUMMARY OF THE INVENTION

Accordingly, an object of the present invention is to provide a covered wire connection method and connection structure in which covered wires can be conductively connected with each other inexpensively and easily, and in which a connection state with excellent electric characteristic can be obtained stably.

In order to achieve the above object, according to the present invention, there is provided a covered wire connection method and structure comprising steps of and formed by steps of overlapping two covered wires each of which comprises a conductive wire portion composed of plurality of core wires and a covered portion covering an outer periphery of the conductive wire portion, placing said wire in a wire supporting portion of a resin chip for restricting a crossing angle of said two covered wires, pinching an overlapping portion of the covered wires between the resin chip having the wire supporting portion and a second resin chip, pressurizing and exciting the overlapping portion pinched by the resin chips using an ultrasonic vibration welding apparatus so as to melt and disperse the cover portion, exposing the conductive wire portion at the overlapping portion electrically conductively connecting the conductive wire portions of the covered wires at the overlapping portion, and melt-fixing the pair of resin chips to seal the connected overlapping portion of the covered wires with the melted resin chips. A crossing angle at the overlapping portion of the two covered wires is set to no less than 45° and no greater than 135°.

According to the construction described above, the covered wires are overlapped with each other at the connection portions (overlapping portion) and the overlapped connection portions are pinched by a pair of the resin chips. Then, the cover portions are melted and dispersed by ultrasonic excitation and further pressed from outside of the resin chips. With such a relatively simple method, the covered wires can be conductively contacted with each other with the connection portions in a sealed condition.

After the covered wires are conductively contacted with each other at the connection portions, the pair of the resin chips are melt-fixed to each other so as to seal the connection portions. With melted and hardened resin chips, a high mechanical strength can be obtained at the connection portions.

The crossing angle of the covered wires is set to no less than 45° and no greater than 135°. Where a pressure applied from the resin chips acts on the covered wires substantially equally without losing balance so that the core wires are greatly loosened and the loosened core wires are gradually spread to a flat shape. Thus, the conductive wire portions of both the covered wires are in contact with each other at a plurality of positions, such that a connection state having as excellent electric characteristic and low contact resistance can be obtained. Thus, no special treatment is needed for the resin chips and a connection state having excellent electric characteristic can be obtained stably and inexpensively.

At least one of the resin chips may contain wire supporting portions for restricting the crossing angle of the two covered wires at the overlapping portion at a desired angle.

According to the construction described above, it is possible to set the crossing angle at a desired angle easily by means of the wire supporting portions provided in the resin chips without providing other member such as the anvil with a means for restricting the crossing angle.

At least one of the resin chips may be made of a transparent material.

According to the construction described above, the spreading of the core wires on the connection portions can be visually checked. Thus, simplification of quality inspection can be achieved.

A covered wire connection structure may further include a protective case for covering the overlapping portion of the two wires as well as neighboring portions thereof. The protective case may contain a body and lid, one side of the body may be open to receive the lid the resin chips may be formed in the body and the lid such that they are integral therewith, respectively, and at least one of the body and the lid may contain protruding portions for restricting the crossing angle of the two wires at the overlapping portion to a desired angle.

According to the construction described above, the pair of the resin chips are melt-fixed to each other to seal the connection portions with their conductive connection state and at the same time, the body is connected to the lid. Thus, the connection portions and the neighboring portions are covered with a protective case. That is, by melt-fixing the pair of the resin chips to each other, the connection portions of two covered wires are sealed and at the same time, the body is connected to the lid in the protective case. Thus, for the connection of the body to the lid, an, other process is not required, and an increase in the number of processes is not induced despite an increase of parts. Further, due to the protective case, protection of the connection portions and the neighboring portions can be achieved.

Additionally, the two covered wires can be maintained at a desired crossing angle because they are caught at the time of ultrasonic excitation. Thus, after the sealing, the connection portions are kept in conductive contact with each other while crossing at the desired crossing angle. Thus, a stabilized electrical performance results.

The protruding portions may be formed so as to have side walls, the two covered wires may be in contact with and directed by the walls so as to cross each other at the desired crossing angle, and the protruding potions may be arranged so as to be opposite each other and adjacent to the resin chips.

According to the construction described above, the connection portions of the two covered wires are arranged so as to cross each other at the desired angle on the resin chip between the protruding portions disposed so as to opposite each other. Because the protruding portions are disposed adjacent to the resin chips, the width of the protruding portion (width between both the side walls) necessary for obtaining a desired crossing angle can be set to a small value so that the protruding portions can be designed in compact fashion. Additionally, a distance between the opposing protruding portions is reduced, so that the crossing state of the connection portions can be maintained stably.

At least one of the body and the lid may contain wire introducing portions for receiving the curved wires and introducing them into the protective case in parallel.

According to the construction described above, the two covered wires in which the connection portions are crossed at the desired crossing angle can be introduced in parallel through the wire introducing portions from the protective case. Thus, it is possible to provide such a covered wire connection structure which can be realized preferably as a wire harness.

The body and the lid may be formed integrally with each other and connected by a hinge portion.

According to the construction described above, by turning the lid on the hinge portion, the lid can be set onto the open portion of the body easily. Further, by this setting, the pair of the resin chips formed on the body and the lid each are arranged such that their melting surfaces oppose each other. That is, because the body and the lid are molded integrally and connected by the hinge portion, management of parts is facilitated. Further, by only turning the lid on the hinge portion, the lid can be set onto the open portion of the body. Thus, positioning of respective parts is not necessary thus simplifying assembly work.

DESCRIPTION OF THE PREFERRED EMBODIMENTS

Hereinafter, a first embodiment of the present invention will be described with reference to the accompanying drawings.

Figure 1:
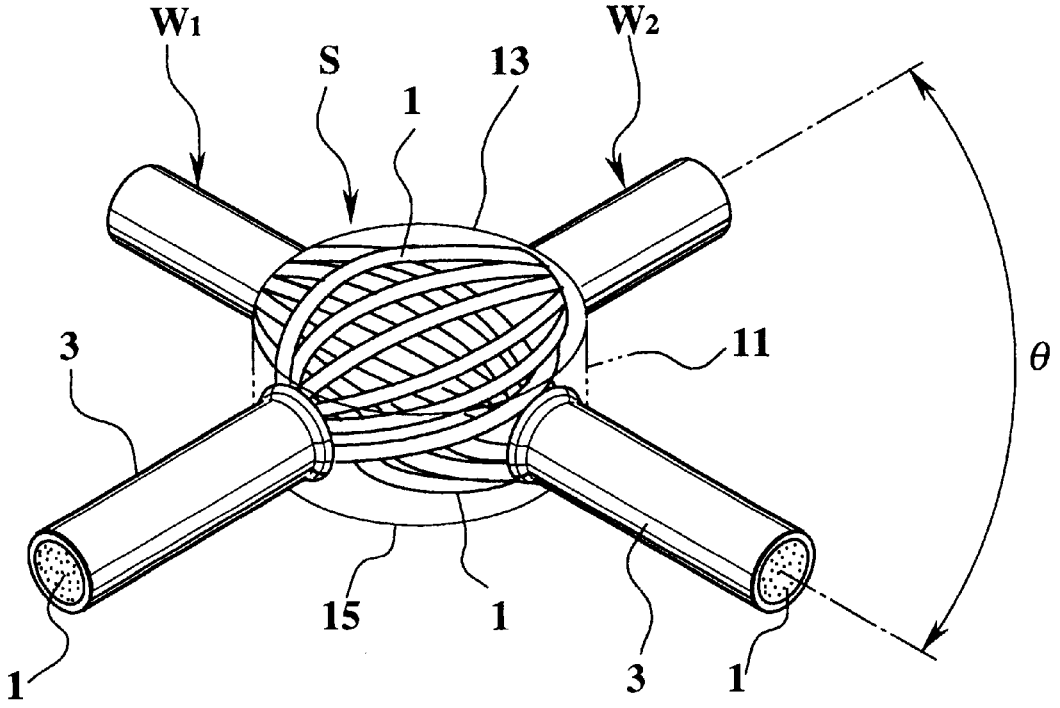
FIG. 1 is a perspective view showing a covered wire connection structure according to a first embodiment of the present invention.
Figure 2:
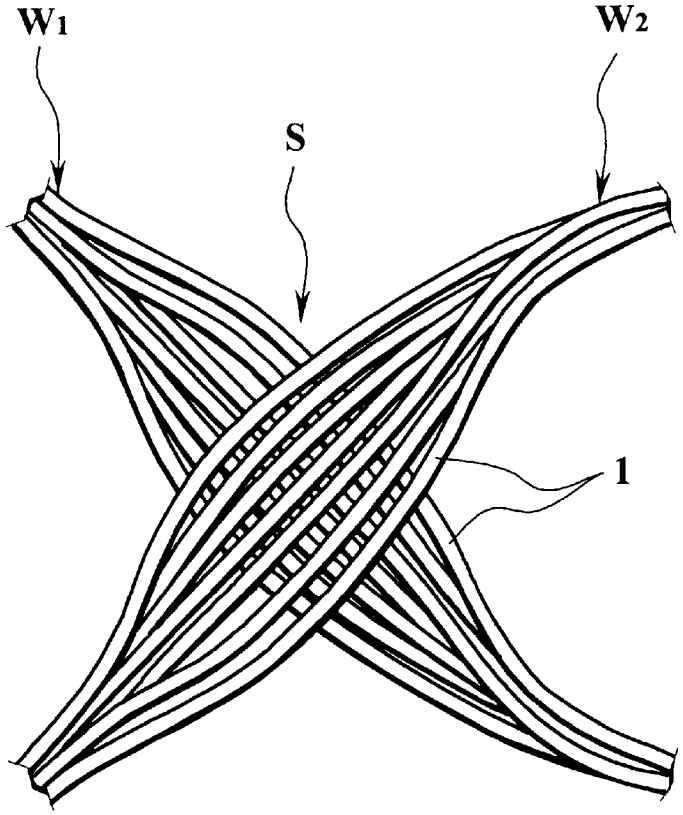
FIG. 2 is an enlarged plan view of the connection portion of FIG. 1.
Figure 3A:
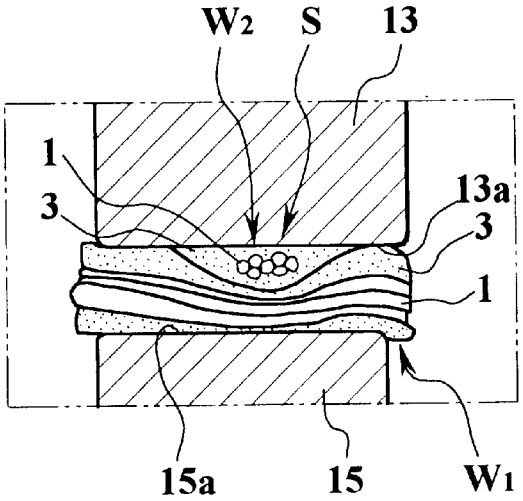
FIG. 3A is a side sectional view schematically showing states of resin chips currently being pressed and excited just after the connection, and shows a state magnified about nine times.
Figure 3B:
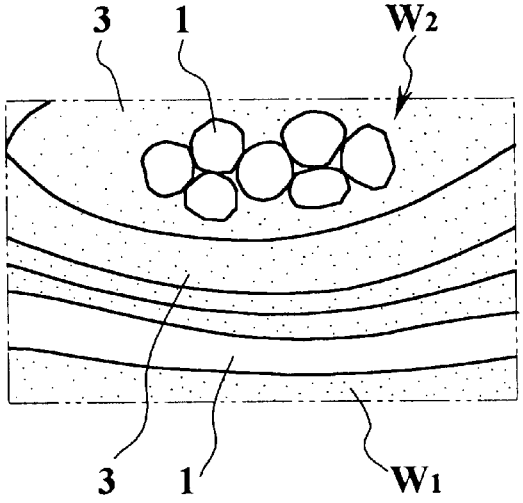
FIG. 3B is a side sectional view schematically showing states of resin chips currently being pressed and excited just after the connection magnified about thirty times.
Figure 4A:
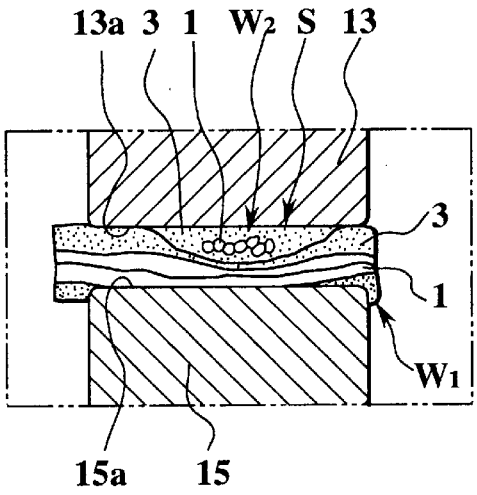
FIG. 4A is a side sectional view schematically showing a state during connection of the resin chips being pressed and excited about nine times.
Figure 4B:
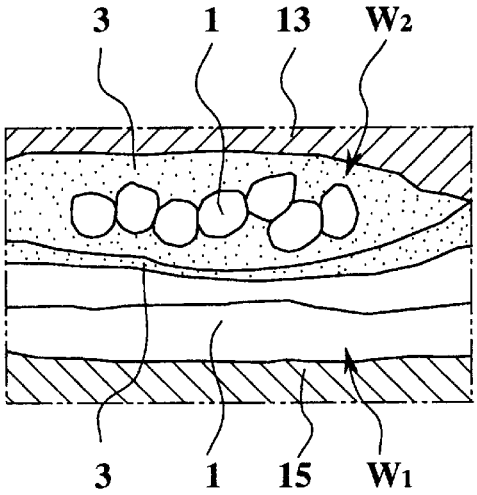
FIG. 4B is a side sectional views schematically showing a state during connection of the resin chips being pressed and excited about thirty times.
Figure 5A:
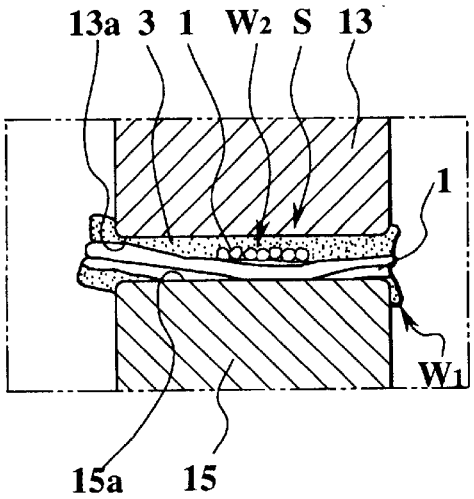
FIG. 5A is a side sectional views schematically showing a state after connection of the resin chips pressed and excited magnified about nine times.
Figure 5B:
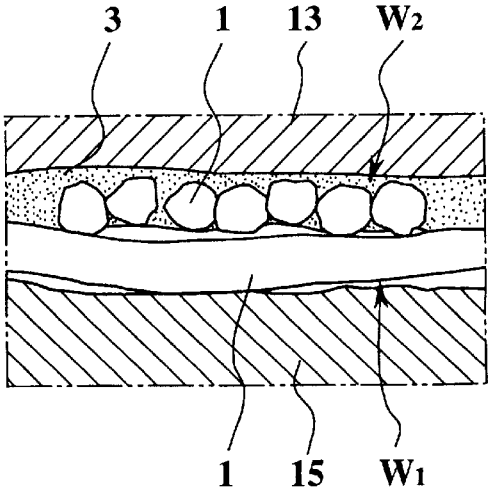
FIG. 5B is a side sectional view schematically showing a state after connection of the resin chips pressed and excited magnified about thirty times.
Figure 6A:
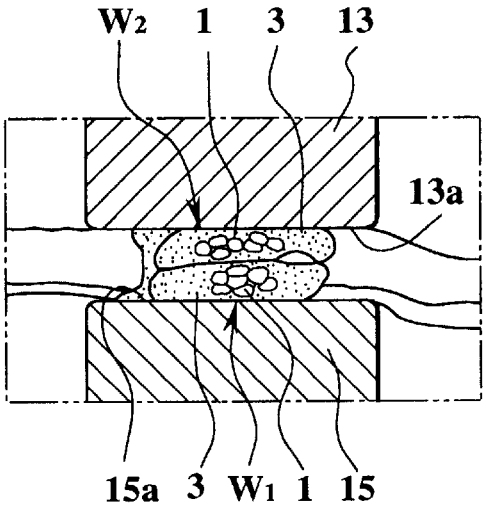
FIG. 6A is a side sectional view schematically showing a state just after connection of the resin chips for reference magnified about nine times.
Figure 6B:
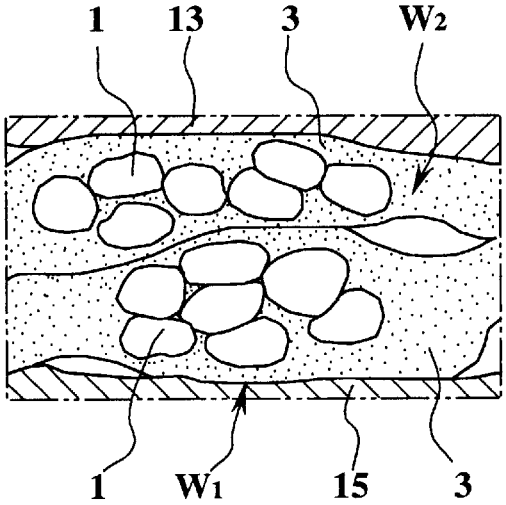
FIG. 6B is a side sectional view schematically showing a state just after connection of the resin chips for reference magnified about thirty times.
Figure 7:
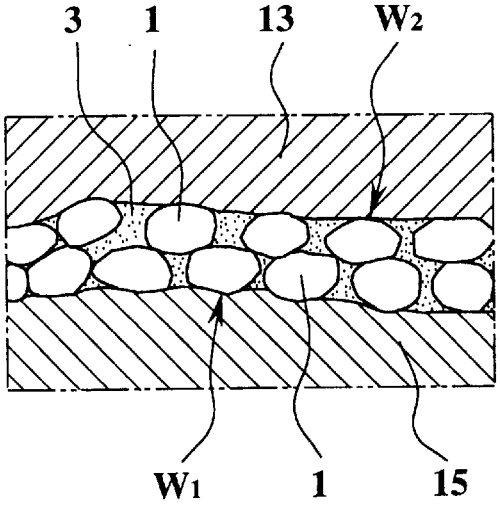
FIG. 7 is a side sectional view showing schematically a state after connection of the resin chips for reference magnified by about thirty times.
Figure 8:
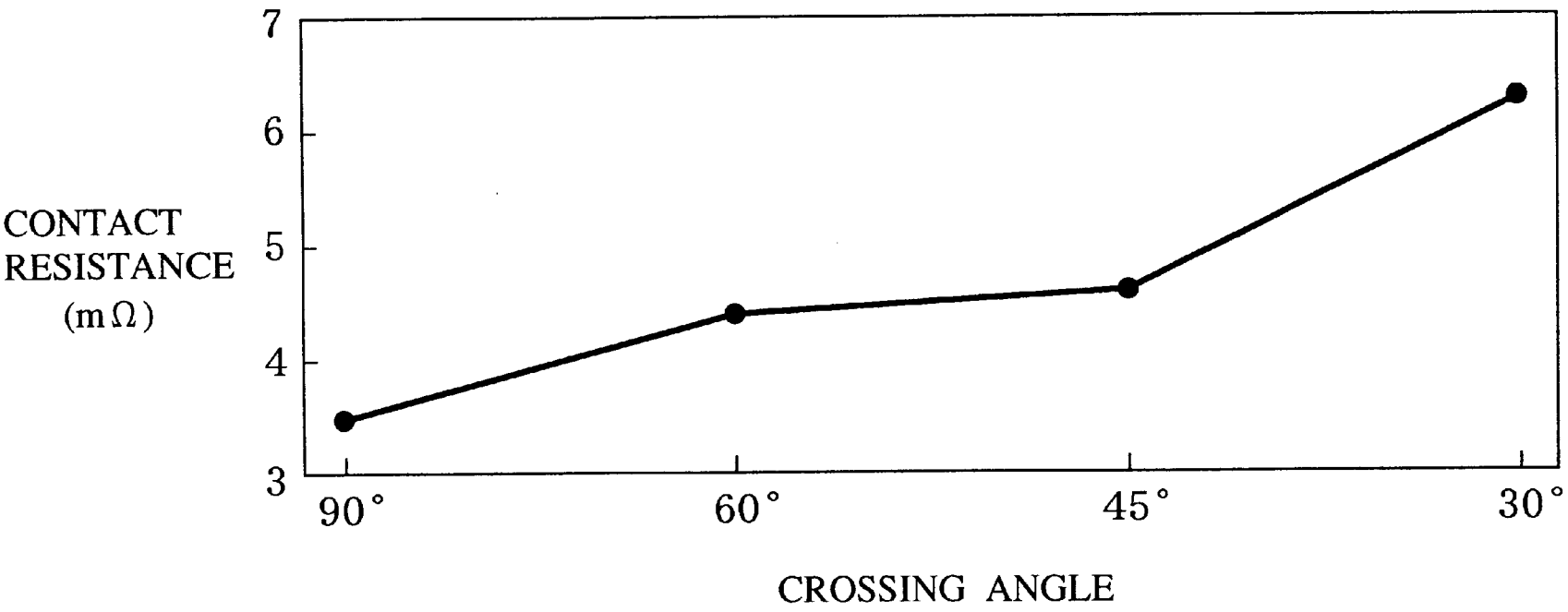
FIG. 8 is a diagram showing a relation between crossing angle and contact resistance.

FIG. 1 is a perspective view showing a covered wire connection structure according to the first embodiment of the instant invention. FIG. 2 is an enlarged plan view of the connection portion of FIG. 1. FIGS. 3–5 are side sectional views showing schematically a state of a resin chip currently under pressing and excitation. FIGS. 3A and 3B show a state just after the connection is started, FIGS. 4A and 4B show a state during connection and FIGS. 5A and 5B show a state after the connection is completed. FIG. 5A of the respective Figures indicates a state enlarged about nine times and FIG. 5B thereof indicates a state enlarged about thirty times. FIGS. 6A, 6B and 7 are side sectional views showing schematically a state of resin chip for reference. FIGS. 6A and 6B show a state just after the connection is started and FIG. 7 indicates a state after the connection is completed. FIG. 6A indicates a state enlarged about nine times and FIG. 6B indicates a state enlarged about thirty times. FIG. 8 is a diagram showing a relation between crossing angle and contacting resistance.

According to the instant embodiment shown in FIG. 1, two covered wires W1, W2 each of which comprises a conductive wire portion 1 and a cover portion 3 which is formed of resin and coated around the outer periphery of the conductive wire portion, are conductively connected to each other at connection portions (overlapping portion) S thereof as shown in FIG. 1. The respective conductive wire portions 1 of the covered wires W1, W2 are each composed of seven core wires (see FIG. 2).

In order to connect two covered wires W1, W2, a pair of resin chips 13, 15 which are resin materials 11, a horn for producing ultrasonic vibration (not shown) and an anvil (not shown) for supporting the covered wires W1, W2 and the resin chips 13, 15 at the time of the connection are utilized. The anvil has a bore portion which is open upward and has a circular cross section and two pairs of groove portions which confront each other with respect to substantially the center of the bore portion for containing the covered wires W1, W2. These four groove portions are open on the same side as the bore portion and the mutually facing groove portions intercommunicates with each other through the bore portion. A crossing angle of lines connecting the mutually facing groove portions is the crossing angle θ in which the covered wires W1, W2 are conductively connected with each other. That angle is set to not less than 45° to not greater than 135° (90° in the instant embodiment). Meanwhile, because the structures of the horn and the anvil are substantially the same as conventional, a detailed description thereof is omitted.

The pair of the resin chips 13, 15 are formed in a circular shape slightly smaller than the bore of the anvil and contain no soldering material unlike conventional chips. The resin chips 13, 15 are made of acrylic resin, ABS (acrylonitrile-butadiene-styrene copolymer) resin, PC (polycarbonate) resin, PVC (polyvinyl chloride) resin, PE (polyethylene) resin, PEI (polyetherimide), PBT (polybuthylene terephtalate) or the like. Generally, the material is harder than vinyl chloride used in the cover portion 3. With respect to the suitability of these resin for use as the resin chips 13, 15, the applicability can be recognized in all the resins in term of the conductivity and conductivity stability, and, if judging from appearance and insulation performance as well, PEI resins and PBT resins are particularly suitable.

The respective resin chips 13, 15 have melting surfaces 13*a*, 15*a* (see FIGS. 3–5) which contact each other when the resin chips 13, 15 are overlapped with each other vertically in the bore portion of the anvil and the connection portions S in which two covered wires W1, W2 cross each other are located in the center of the melting surfaces 13*a*, 15*a*.

In order to connect the two covered wires W1, W2, first the covered wires W1, W2 are overlapped with each other at the connection portions S and the overlapped connection portions S are pinched vertically by a pair of the resin chips 13, 15. Concretely, one resin chip 15 is inserted into the bore portion of the anvil so that its melting surface 15*a* is directed upward and one covered wire W1 is inserted into confronting groove portions of one pair such that it is located over the resin chip 15. Then, the other covered wire W2 is inserted into the other confronting groove portion. Finally, the other (upper) resin chip 13 is inserted with its melting surface 13*a* directed downward. Both the covered wires W1, W2 are arranged such that the respective connection portions S cross each other in the center of the bore portion. Consequently, the connection portions S are pinched in the center of the melting surfaces 13*a*, 15*a* of the upper and lower resin chips 13, 15 vertically in the overlapping direction. With this condition, the crossing angle θ between the cored wires W1 and W2 is limited to substantially 90° which is a crossing angle of the confronting groove portions.

Subsequently, the cover portions 3 at the connection portions S of the covered wires are melted so as to be dispersed by ultrasonic vibration. Furthermore, the conductive wire portions (core) of the covered wires W1, W2 are conductively contacted with each other at the connection portion S by pressing the covered wires from the outside of the resin chips 13, 15. Thereafter, the pair of the resin chips 13, 15 are mutually melted at the melting surfaces 13*a*, 15*a* to seal the connection portion S (see FIGS. 3–5).

Specifically, the horn is inserted onto the upper side (other side) of the finally-inserted upper resin chip 13 and the connection portions S are excited and pressed from the outside of the upper and lower resin chips 13, 15 between the horn and the anvil. The press of the connection portion S is performed by pressing the horn toward the anvil, and the press direction is coincident with the overlapping direction of the covered wires.

When the resin materials 11 are melt-fixed to each other by the ultrasonic vibration, the excitation is preferably performed in a direction which substantially perpendicularly intersects to the connection surface of the resin materials 11 because it provides the most excellent melt-fixing state. Therefore, the direction of the excitation of the connection portion S is set to a direction which crosses the confronting surfaces 13*a*, 15*a* of the resin chips 13, 15, that is, it is set to be coincident with the overlapping direction of the covered wires W1, W2. With this arrangement, longitudinal vibration is produced from the horn.

When the connection portions S are pressed and excited in the above state, the cover portions 3 are first melted and the conductive wire portions 1 of the covered wires W1, W2 are exposed at the connection portion S between the resin chips 13 and 15. At this time, the melted cover portions 3 are extruded from the center side of the resin chips 13, 15 toward the outside thereof because the connection portions S are pressed from the upper and lower sides, so that the conductive wire portions 1 are more clearly exposed and indirect conductive contact with each other. Like the press direction, the direction of the excitation of the connection portions S is set to be coincident with the overlapping direction of the covered wires W1, W2, so that the action of extruding the melted cover portions 3 from the center between the resin chips 13, 15 to the outside thereof is promoted.

If the pressing and excitation of the connection portions S continues after the cover portions 3 are melted, the resin chips 13, 15 will melt such that the melting surfaces 13*a*, 15*a* of both the resin chips 13, 15 are melt-fixed to each other. Outer peripheral faces of the cover portions 3 adjacent to the conductive wire portions 1 which are conductively contacted with each other are melt-fixed to the resin chips 13, 15. Consequently, the outer peripheral faces of the conductive wire portions 1 conductively contacted are covered with the melted resin chips 13, 15 (see FIG. 1).

Because the crossing angle θ between the covered wires W1 and W2 is set to 90°, a force from the resin chips 13, 15 is applied to the covered wires W1, W2 (core wires of the conductive wire portion 1) substantially equally, keeping a balance when the connection portions S are pressed and excited. As a result, first the core wires are loosened and the loosened core wires are spread gradually so that they become flat (see FIGS. 3–5). Consequently, the conductive wire portions 1 of both the covered wires W1, W2 are contacted with each other at a plurality of positions (see FIG. 2).

Here, an example of results of the experiments will be shown. If the crossing angle θ is 90°, it has been recognized that the number of contact points between both the core wires exceeds 30 points. This indicates that they are contacted with each other at a large number of points because the maximum number of contact points is 49 (see FIG. 2), if each of the seven core wires of W1 are made to contact each of the seven core wires of W2.

Further, if a percentage of occurrence of unbalanced spreading of the core wires is obtained when the crossing angle θ varies in a range between 90° and 30°, it is 0% in a range between 90° and 60°, and it is as low as 11% when the crossing angle is 45°. However, it is recognized that the percentage is as high as 89% when the crossing angle is 30°. If the crossing angle θ is small (about 30°), as shown in FIGS. 6, 7, the core wires of the upper covered wire W2 enter in between the core wires of the lower covered wire W1 easily such that a force applied from the resin chips 13, 15 acts with lost balance. On the other hand, if the crossing angle θ is large (90°), as shown in FIGS. 3–5, the core wires of the upper covered wires W2 are unlikely to enter in between the core wires of the lower covered wires W1. This is because a force applied from the resin chips 13, 15 act equally with keeping balance.

In a relationship between the crossing angle θ and contact resistance obtained through experiments, as shown in FIG. 8, the contact resistance is less than 5 mΩ, when the crossing angle θ is 90°–45°. If the crossing angle becomes smaller than 45°, the contact resistance rises largely and when 30°, the contact resistance exceeds 5 mΩ.

From what has been said above, it is found that if the crossing angle θ is decreased from 90°, the spreading of the core wires deteriorates such that the number of contact points between the core wires is reduced and then contact resistance increases. A range of the crossing angle θ in which stable conductive contacting can be obtained with a low contact resistance is preferably 90°±45° (45°–135°). Particularly 90° is the most appropriate.

According to the connection method of the instant embodiment, by pressing the resin chips 13, 15 from outside so as to melt and disperse the cover portion 3 with the covered wires W1, W2 overlapped at the connection portions S and the connection portions S pinched by a pair of the resin chips 13, 15, the covered wires W1, W2 can be conductively connected with each other at the connection portions S. Thus, when conductively connecting the covered wires W1, W2, it is not necessary to remove the cover portion 3 and obtain conductive connection by a simple operation.

Further, according to the connection method and the connection structure obtained thereby, after the covered wires W1, W2 are conductively connected with each other at the connection portions S, the upper and lower resin chips 13, 15 are melt-fixed to each other to seal the connection portions S. Thus, the melted and hardened resin chips 13, 15, allow a high mechanical strength to be obtained at the connection portions S.

Further, because the resin chips 13, 15 have only to have a dimension capable of pinching the connection portions S to be conductively contacted vertically the area necessary for the connection can be restricted to a small area. Further, because the connection portions S are sealed by the resin chips 13, 15, it is possible to ensure a sufficient insulation.

Thus, high mechanical strength and sufficient insulation allow the conductive characteristic between the covered wires W1 and W2 at the connection portions S can be stabilized.

Furthermore, the covered wires W1, W2 are pinched by the pair of the resin chips 13, 15 in the overlapping direction thereof and the connection portions S are pressed and excited between the horn and the anvil from the outside of the resin chips 13, 15 and the direction of the pressing is set to the same as the direction in which the covered wires W1,W2 are overlapped with each other. Thus, when the connection portion S is pressed, the melted cover portions 3 are extruded out from the center portion of the resin chips 13, 15 toward outside so that the conductive wire portions 1 are sufficiently exposed to thereby effectively obtain a secure conductive contacting state. Further, because the direction of excitation to the connection portion S is set to the same as the direction in which the covered wires W1, W2 are overlapped with each other like the pressing direction, it is possible to obtain excellent melting of the resin chips 13, 15 and enhance the action of pushing out the cover portions 3.

Further, the crossing angle θ between the covered wires W1 and W2 is set to be no less than 45° and no greater than 135°, where a pressure applied from the resin chips 13, 15 acts substantially equally on the core wires without losing balance such that they are loosened very well, the conductive wire portions 1 of the covered wires W1, W2 are contacted with each other at a plurality of positions. Consequently, a stable connecting state with an excellent electric characteristic can be obtained. Particularly, in the instant embodiment, the crossing angle θ is set to 90° in which the core wires can be greatly loosened. Thus, it is possible to achieve improvement of electric characteristic and stabilization thereof.

Further, it is not necessary to make special treatment for the pair of the resin chips 13, 15 such as embedding of solder, unlike conventional chips. Thus, they can be constructed inexpensively. Further, different from a case in which solder is provided, no flux is produced at the connection portions S, so that reliability of electric connection performance is not reduced.

Further, by making at least one of the resin chips 13, 15 with a transparent material, it is possible to visually check the spreading of the core wires at the connection portions S. Thus, the conductive connecting state between the covered wires W1 and W2 can be visually determined thereby simplifying quality inspection.

It is permissible to use resin chips 13, 15 having a relatively low viscosity at the time of melting. Then, when melting the resin chips 13, 15 to surround the connection portion S, the melted resin chips 13, 15 may fill in gaps between plural core wires composing the conductive wire portion 1 in the neighboring conductive wire portions 1, excluding the connection portion S, to fill gaps formed between the cover portions of the covered wires W1,W2 and the core wires or gaps formed between the core wires, with resin material 11, thereby obtaining an effect of sealing against water inside of the covered wires W1, W2. Thus, for example, in a case in which one end of the covered wires W1, W2 is connected to a portion requiring waterproofing (waterproofed portion) and the other end thereof is connected to a portion not requiring water proofing (non-waterproofed portion), water or the like may enter inside of the covered wires W1, W2 from the other end and due to capillary phenomenon, flows inside of the covered wires W1, W2. However, water is prevented from entering to the one end by the aforementioned effect of sealing against water. Thus, it is possible to secure water proof performance at the one end without providing the other end with a water proof structure. That is, if both ends of the covered wires W1,W2 are connected to the water proofed portion and the non-waterproofed portion, it is possible to secure waterproof performance in the waterproofed portion without providing the non-waterproofed portion with a waterproofing structure, by a simple and inexpensive method and structure.

Next, a second embodiment of the present invention will be described with reference to the accompanying drawings.

Figure 9:
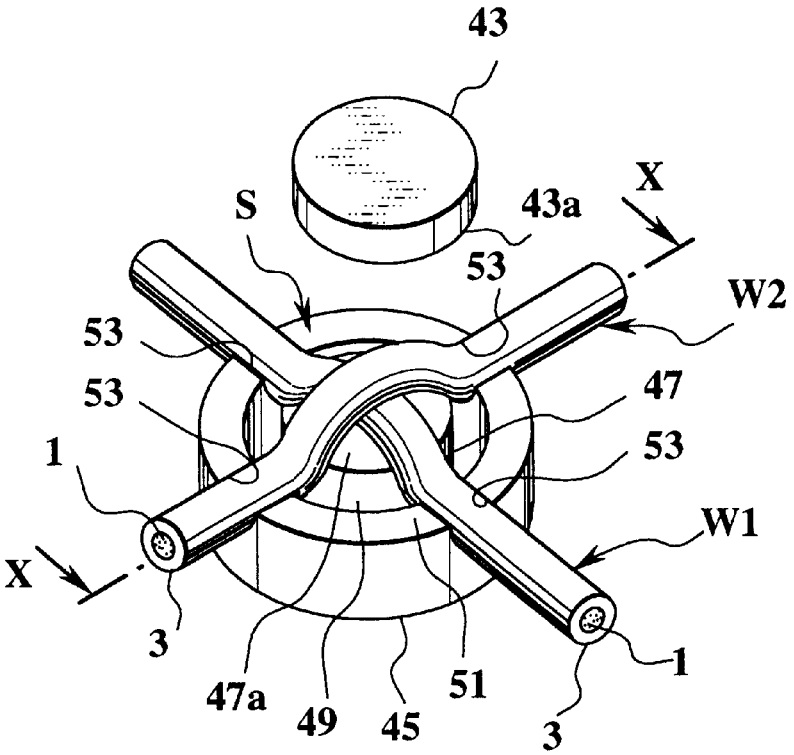
FIG. 9 is a perspective view showing a connecting structure of the covered wires according to a second embodiment of the present invention.

FIG. 9 is a perspective view showing a covered wire connection structure according to the second embodiment of the present invention.

Figure 10:
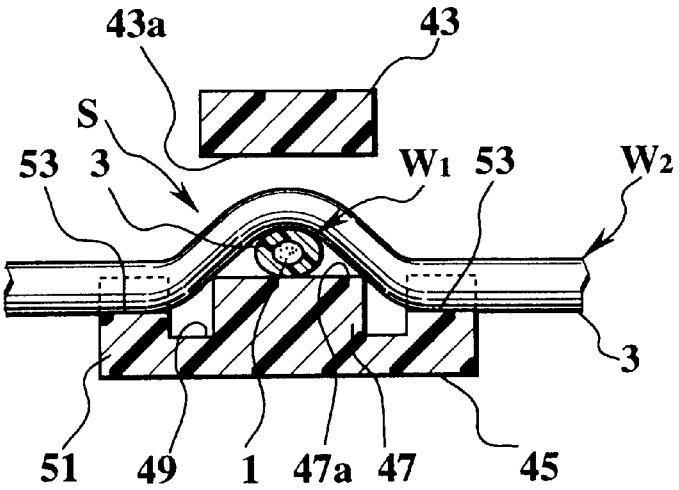
FIG. 10 is a sectional view taken along the lines X—X in FIG. 9.

FIG. 10 is a sectional view taken along the lines X—X.

The same components as the aforementioned first embodiment are provided with the same reference numerals and a description thereof is omitted.

According to the instant embodiment, the lower resin chip 45 is provided with wire containing grooves 53 which are wire supporting members for restricting the crossing angle θ at the connection portions S between the two covered wires W1 and W2 to a desired angle.

The lower resin chip 45 comprises a chip body 47 which is of substantially cylindrical shape and in which a top surface thereof is a melting surface 47*a*, a circumferential portion 51 formed around the chip body 47 in a doughnut shape and a groove portion 49 formed between the chip body 47 and the circumferential portion 51 which is open upwardly and in a donut configuration. The circumferential portion 51 has two pairs of wire containing grooves 53 (four positions) which face each other with respect to the center of the melting surface 47*a* and open upwardly. The crossing angle of a line connecting the mutually facing wire containing grooves 53 is the crossing angle θ used when conductively connecting the covered wires W1 and W2. That angle is set to be no less than 45° and no greater than 135°, (90° in the instant embodiment), as in, the first embodiment. The melting surface 47*a* of the chip body 47 is formed at a position (height) positioned upward or downward from a bottom of the wire containing groove 53. If the covered wires W1, W2 are set in the mutually confronting wire containing grooves 53 and pressed, the covered wires W1, W2 are bent at peripheral portions of the chip body 47 and the groove portion 49, and then contained in the wire containing grooves 53, such that they are temporarily held. Both the covered wires W1, W2 cross each other at a desired crossing angle θ, substantially at the center of the lower melting surface 47*a*. Meanwhile, the upper resin chip 43 is formed in a circular shape so that a bottom face thereof is a melting surface 43*a* as in the first embodiment. The upper and lower melting surfaces 43*a*, 47*a* are of substantially the same shape and dimension. Although according to the instant embodiment, only the lower resin chip 45 is provided with the wire containing grooves 53, it is possible to provide both the upper and lower resin chips 43, 45 with such wire containing grooves 53 or provide only the upper resin chip 43 with the wire containing grooves.

According to the instant embodiment, in addition to the effects of the first embodiment, it is possible to set the crossing angle θ at any desired angle by means of the wire containing grooves 53 provided in the lower resin chip 45 without providing additional groove portions for restricting the crossing angle θ in the anvil like the first embodiment.

Further like the first embodiment, by making at least one of the resin chips 43, 45 with a transparent material, it is possible to visually check the conductive connecting state between the covered wires W1 and W2 to some extent, and it is possible to ensure waterproofing effect within the covered wires W1, W2 by filling gaps between neighboring core wires, excluding the connection portions S, with melted resin chips 43, 45 when the resin chips 43, 45 are melt-fixed to each other with the connection portions S set therebetween.

Next, a third embodiment of the present invention will be described with reference to the accompanying drawings.

Figure 11A:
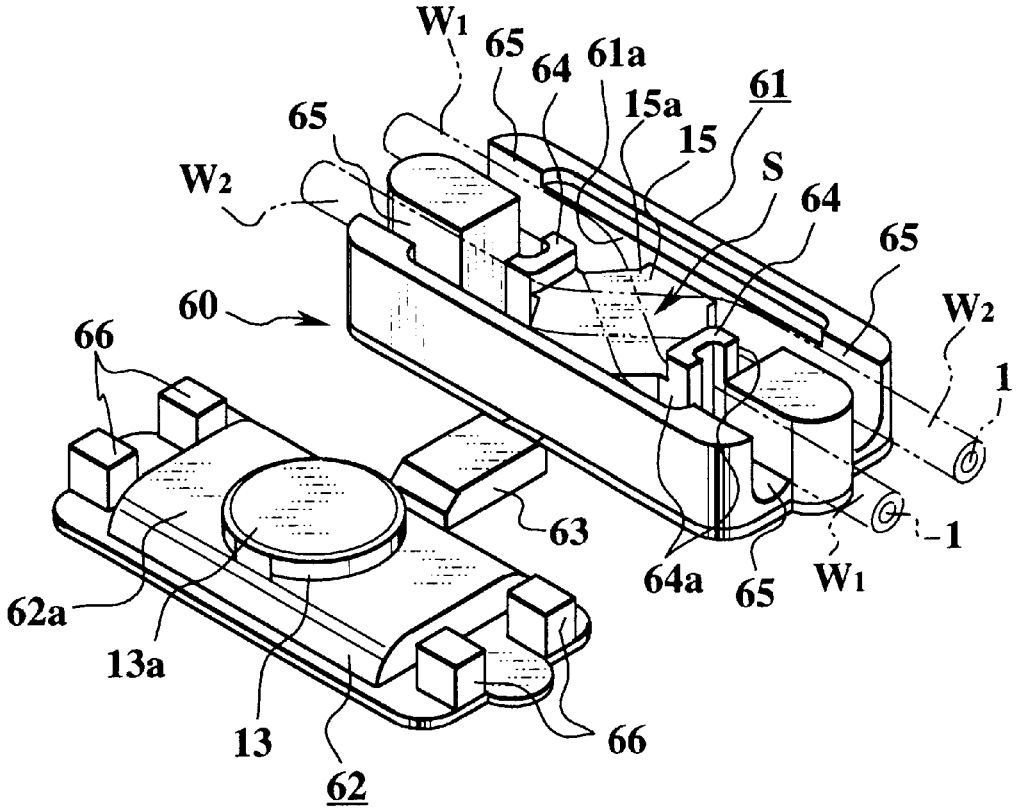
FIG. 11A is a perspective view of a free state of a protective case for use in a third embodiment of the present invention.
Figure 11B:
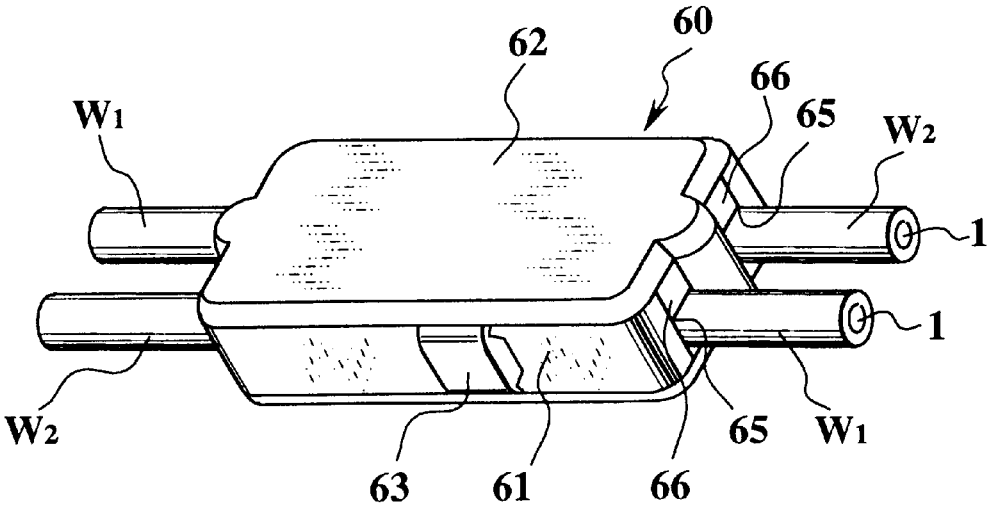
FIG. 11B is a perspective view of an appearance of major parts after two covered wires are connected according to the third embodiment of the present invention.
Figure 12:
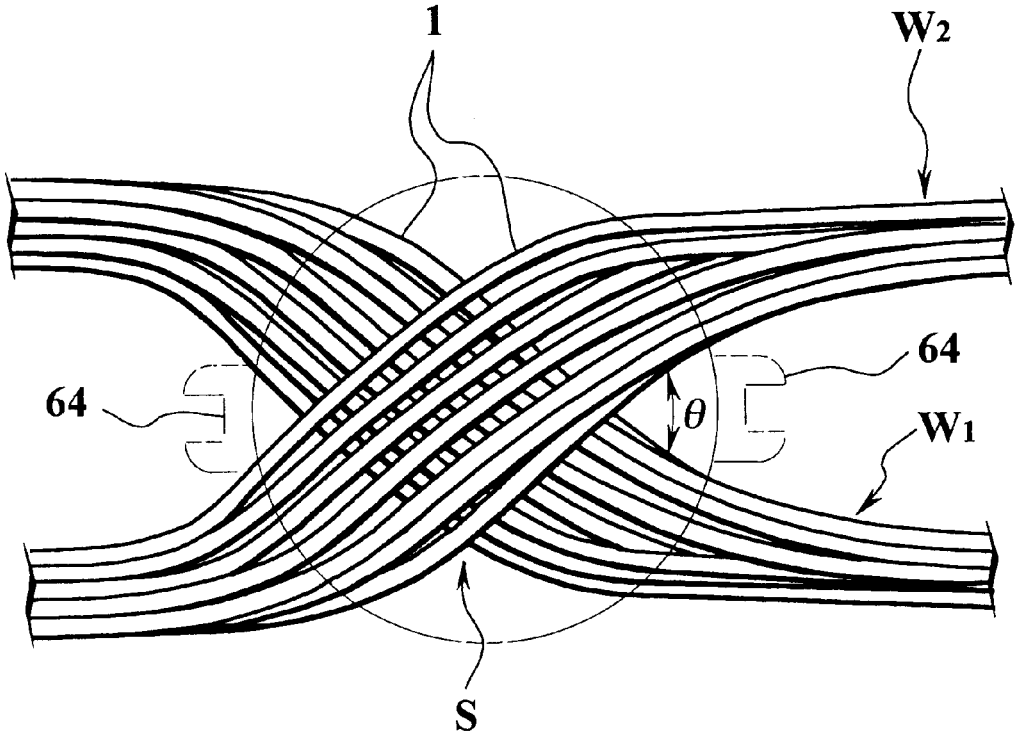
FIG. 12 is a plan view showing the conductive connecting state of the core wires of two covered wires according to a third embodiment of the present invention.

FIG. 11A is a perspective view of a free state of a protective case for use in the instant embodiment. FIG. 11B is a perspective view of an appearance of major parts after two covered wires are connected according to the instant embodiment. FIG. 12 is a plan view showing a conductive contacting state of the core wires of two covered wires according to the instant embodiment.

The instant embodiment of the present invention is constructed mainly of a pair of the resin chips 13, 15 and a protective case 60 having a protruding portion 64 for restricting the crossing angle of two covered wires W1, W2 to a desired angle.

The protective case 60 comprises a case body 61 in which a wire containing portion 61*a* for two covered wires W1, W2 is formed so as to open to one side and a lid body 62 formed in a plate shape having a thick portion 62*a* for closing an opening portion of the wire containing portion 61*a*.

Of the pair of the resin chips 13, 15, one resin chip 13 is formed so as to protrude substantially in the center of an inside surface (side located inside of the case 60 when closed) of a thick portion 62*a* of the lid body 62 integrally with the lid body 62. The other resin chip 15 is formed so as to protrude substantially in the center of a bottom of the wire containing portion 61 integrally with the wire containing portion 61. The resin chips 13, 15 have melting surfaces 13*a*, 15*a* respectively which are protruded therefrom. The resin chips 13, 15 are constructed so that the respective melting surfaces 13*a*, 15*a* face each other when the lid body 62 is closed.

The protruding portions 64 are formed in the wire containing portion 61*a* of the case body 61 in one pair.

That is, the pair of the protruding portions 64, 64 are formed to have both side walls 64*a*, 64*a* with which two covered wires W1, W2 are in contact so as to be bent at a desired crossing angle, and allocated adjacent to the resin chip 15 so as to oppose each other. At this protruding portion 64, the crossing angle may be controlled by a distance between the side walls 64*a* and 64*a*, that is, a width of the protruding portion 64. This protruding portion 64 is formed with such a width to obtain a desired crossing angle. At this time, the protruding portion 64 is protruded over the melting surface 15*a* of the resin chip 15 and lower than a depth of the wire containing portion 61. Both the side walls 64*a*, 64*a* of this protruding portion have the aforementioned function.

Preferably as in the instant embodiment, wire introducing portions 65 for introducing two covered wires W1, W2 from the protective case 60 in parallel are formed. The wire introducing portions 65 are formed by cutting in a U-shaped groove form both ends of the wire containing portion 61*a* in which the pair of the protruding portions 64, 64 are located, such that they are opened in the same direction as that of the wire containing portion 61*a* and go through those ends. Two wire introducing portions 65 are provided on each of both the ends of the wire containing portion 61*a*. Corresponding to the wire introducing portions 65, square pillar pressing portions 66 which enter into the wire introducing portions 65 for pressing the covered wire W1(W2) when the lid body 62 is closed are formed on both sides of the thick portion 62*a* of the lid body 62.

Preferably as in the instant embodiment, the case body 61 and the lid body 62 are formed integrally with a hinge portion 63.

In the instant embodiment having the above protective case 60, a covered wire connection structure is obtained in the following manner.

First, as shown in FIG. 11, two covered wires W1, W2 are set in the case body 61. That is, the respective covered wires W1, W2 are placed such that their connection portions S cross each other substantially in the center of the melting surface 15*a* of the resin chip 15 and both sides of the connection portion S are curved along both the side walls 64*a* of the protruding portions 64 and engaged in the corresponding wire introducing portions 65. The respective connection portions S of two covered wires W1 and W2 are caught by the pair of the protruding portions 64, 64 such that they intersect each other at a desired crossing angle.

Next, the lid body 62 is turned via the hinge portion 63 and the pressing portions 66 are engaged into the wire introducing portions 65. Then, the wire containing portion 61*a* of the case body 61 is closed with the lid body 62. In this closing state, the connection portions S are pinched by the melting surfaces 13*a*, 15*a* of the resin chips 13, 15 in the center thereof vertically in a direction of overlapping the resin chips 13, 15.

The same covered wire connection structure as in the first embodiment can be obtained by ultrasonic excitation using the horn as in the first embodiment. According to this connection structure, as shown in FIG. 11B, the two covered wires W1, W2 are introduced in parallel from both ends of the protective case 60 in such a state in which both sections of the covered wires adjacent to the connection portions S are pressed by the pressing portions 66 and engaged in the wire introducing portions 65.

According to the instant embodiment, in addition to the effects of the first embodiment, the following particular effects may be exerted.

That is, the pair of the resin chips 13, 15 are melt-fixed to each other such that the connection portions S are sealed in a state in which they are conductively connected and the case body 61 is connected with the lid body. Consequently, the connection portions S and the neighboring portions are covered with the protective case 60 and protected against any external force.

Further, the two covered wires W1, W2 are fixed at the protruding portions 64 by ultrasonic excitation such that they are maintained at a desired crossing angle.

After sealing, the connection portion S is in conductive connecting state so that the core wires 1 cross each other at a crossing angle θ (substantially 90° in the instant embodiment) thereby exerting a stabilized electric performance.

Because the protruding portions 64 are disposed adjacent to the resin chips 15, a width of the protruding portion 64 necessary for obtaining a desired crossing angle at the connection portion S may be designed to be small. Consequently, it is possible to design the protective case 60 in a compact size. Further, a distance between the opposing protruding portions 64 and 64 is reduced such that the connection portion S located therebetween can be maintained stably at a desired crossing angle.

Further, according to the instant embodiment, as shown in FIG. 1B, the two covered wires W1, W2 in which the connection portions S are intersected at a desired crossing angle are introduced in parallel through the wire introducing portions from the protective case 60. Thus, this may be preferably applicable as wire harness.

Further, according to the instant embodiment, the case body 61 and the lid body 62 are formed integrally with each other through the hinge portion 63. Thus, management of the parts is facilitated and only by turning the lid body 62 via the hinge portion 63, it can be set to the open portion of the case body 61. Thus, positioning of the parts is not necessary and the assembly work may be simplified.

As a modification of the instant embodiment, the following may be considered.

If at least one of the resin chips 13, 15 is made with a transparent material and then a case 61 (or lid body 62) in which that resin chip 15 (or 13) is disposed is also made with a transparent material, the conductive connecting state of the two covered wires W1, W2 can be visually checked thereby simplifying quality inspection.

Further, the protruding portions 64 and the wire introducing portions 65 may be provided on the lid body 62. Further, the hinge portion 63 may be cut off after the lid body 62 is connected to the case body 61.

What is claimed is:

1. A method for connecting covered wires, comprising:

overlapping the two covered wires, each of said wires comprising a conductive wire portion composed of a plurality of core wires and a cover portion covering an outer periphery of the conductive wire portion;

placing said wires in a wire supporting portion of a resin chip for restricting a crossing angle of said two covered wires;

pinching an overlapping portion of said wires between the resin chip having the wire supporting portion and a second resin chip;

pressurizing and exciting said overlapping portion pinched by said resin chips;

exposing the conductive wire portions of the covered wires at the overlapping portion;

conductively connecting the conductive wire portions of said covered wires at said overlapping portion; and melt-fixing the resin chips to one another to seal the connected overlapping portion of said covered wires with said melted resin chips.

2. The method of claim 1, wherein the placing step includes placing the wires in selected wire supporting portions such that the crossing angle at the overlapping portion of said two covered wires is between 45° and 135°.

3. The method of claim 1, wherein the placing step includes placing the wires in selected wire supporting portions such that the crossing angle at the overlapping portion of said two covered wires is 90°.

4. The method of claim 1, wherein the pressurizing and exciting includes using an ultrasonic vibration welding apparatus so as to melt and disperse the cover portion of the covered wires.

5. A covered wire connection structure, comprising:

two covered wires, each of said wires comprising a conductive wire portion composed of a plurality of core wires and a cover portion covering an outer periphery of the conductive wire portion;

said wires overlapping one another to form a crossing angle between them; wherein the overlapping portion of said wires does not include a cover portion, such that the plurality of core wires of one wire are conductively connected to the plurality of core wires of the other wire, wherein the overlapping wires are sealed between a pair of melt-fixed resin chips, at least one of the resin chips including a wire supporting portion for restricting the crossing angle of said two covered wires; and wherein said structure is formed by the steps of:

overlapping the two covered wires;

placing said wires in a wire supporting portion of the resin chip for restricting a crossing angle of said two covered wires;

pinching the overlapping portion of said wires between the resin chip having the wire supporting portion and the second resin chip;

pressurizing and exciting said overlapping portion pinched by said resin chips;

exposing the conductive wire portions of the covered wires at the overlapping portion;

conductively connecting the conductive wire portions of said covered wires at said overlapping portion; and melt-fixing the resin chips to one another to seal the connected overlapping portion of said covered wires with said melted resin chips.

6. The structure of claim 5, wherein the wire supporting portions are spaced such that the crossing angle at the overlapping portion of said two covered wires is between 45° and 135°.

7. The structure of claim 5, wherein the wire supporting portions are spaced such that the crossing angle at the overlapping portion of said two covered wires is 90°.

8. The structure of claim 5, wherein at least one of the resin chips is transparent.

9. The structure of claim 5, wherein both resin chips include wire supporting portions.

10. A covered wire connection structure, comprising:

two covered wires, each of said wires comprising a conductive wire portion composed of a plurality of core wires and a cover portion covering an outer periphery of the conductive wire portion;

said wires overlapping one another to form a crossing angle between them; wherein the overlapping portion of said wires does not include a cover portion, such that the plurality of core wires of one wire are conductively connected to the plurality of core wires of the other wire, wherein the overlapping wires are sealed between a pair of melt-fixed resin chips; and a protective case for covering the overlapping portion of said wires, said case including a body and a lid, wherein one side of the body is open to receive and be closed by the lid;

one of said body and said lid including protruding portions for restricting the crossing angle of the two wires at said overlapping portion to a desired angle, wherein said resin chips are integrally formed with said body and said lid, respectively; and wherein said structure is formed by the steps of:

introducing the two covered wires into the protective case and overlapping the two covered wires;

setting the lid of the protective case onto the open portion of the body of the protective case and pinching the overlapping portion of said wires between the pair of resin chips located on the lid and the body, respectively;

pressurizing and exciting said overlapping portion pinched by said resin chips;

exposing the conductive wire portions of the covered wires at the overlapping portion;

conductively connecting the conductive wire portions of said covered wires at said overlapping portion; and melt-fixing the resin chips to one another to seal the connected overlapping portion of said covered wires with said melted resin chips.

11. The structure of claim 10, wherein the crossing angle at the overlapping portion of said two covered wires is between 45° and 135°.

12. The structure of claim 10, wherein the crossing angle at the overlapping portion of said two covered wires is 90°.

13. The structure of claim 10, wherein at least one of the resin chips is transparent.

14. The structure of claim 10, wherein said protruding portions include side walls and are on opposite sides of and adjacent to one of said resin chips, and wherein said side walls contact and direct said wires into the desired crossing angle.

15. The structure of claim 10, wherein at least one of said body and said lid includes wire introducing portions for receiving said covered wires and introducing them into the protective case in parallel.

16. The structure of claim 10, wherein said body and said lid are integrally formed and are connected to one another by a hinge portion.

* * * * *